US007735599B2

(12) United States Patent
Kubota

(10) Patent No.: US 7,735,599 B2
(45) Date of Patent: Jun. 15, 2010

(54) SOUND WAVE GUIDE STRUCTURE FOR SPEAKER SYSTEM AND HORN SPEAKER

(75) Inventor: Hiroshi Kubota, Hyogo (JP)

(73) Assignee: TOA Corporation, Kobe-shi (JP)

( * ) Notice: Subject to any disclaimer, the term of this patent is extended or adjusted under 35 U.S.C. 154(b) by 761 days.

(21) Appl. No.: 10/550,318

(22) PCT Filed: Mar. 25, 2004

(86) PCT No.: PCT/JP2004/004232

§ 371 (c)(1),
(2), (4) Date: Nov. 17, 2006

(87) PCT Pub. No.: WO2004/086812

PCT Pub. Date: Oct. 7, 2004

(65) Prior Publication Data

US 2007/0080019 A1 Apr. 12, 2007

(30) Foreign Application Priority Data

Mar. 25, 2003 (JP) ..... 2003-082899

(51) Int. Cl.

| | |
|---|---|
| ***G10K 11/02*** | (2006.01) |
| ***G10K 11/08*** | (2006.01) |
| ***G10K 11/18*** | (2006.01) |
| ***H04R 1/30*** | (2006.01) |
| *G10K 11/00* | (2006.01) |
| *H04R 1/20* | (2006.01) |

(52) U.S. Cl. ..... 181/192; 181/185; 381/340

(58) Field of Classification Search ..... 181/192, 181/152, 159, 185, 187, 188; 381/340, 343, 381/339, 337

See application file for complete search history.

(56) References Cited

U.S. PATENT DOCUMENTS

| | | | | | |
|---|---|---|---|---|---|
| 1,871,243 | A | * | 8/1932 | Smythe | 181/187 |
| 2,001,089 | A | * | 5/1935 | Blattner | 181/187 |
| 2,203,875 | A | * | 6/1940 | Olson | 181/187 |
| 2,684,724 | A | * | 7/1954 | Kock | 181/176 |
| 3,957,134 | A | * | 5/1976 | Daniel | 181/176 |
| 4,091,891 | A | * | 5/1978 | Hino et al. | 181/185 |
| 4,157,741 | A | * | 6/1979 | Goldwater | 381/342 |
| 4,685,532 | A | * | 8/1987 | Gunness | 181/185 |
| 4,776,428 | A | * | 10/1988 | Belisle | 181/185 |
| 5,163,167 | A | | 11/1992 | Heil | |

(Continued)

FOREIGN PATENT DOCUMENTS

JP 03204298 A * 9/1991

OTHER PUBLICATIONS

International Search Report for International Application No. PCT/JP2004/004232 by the Japanese Patent Office dated Jul. 6, 2004 (1 page).*

*Primary Examiner*—Edgardo San Martin
(74) *Attorney, Agent, or Firm*—Marshall, Gerstein & Borun LLP

(57) ABSTRACT

A sound wave guide structure for a speaker system comprises a sound passage space connecting an inlet opening 11 to an outlet opening 12. The sound passage space branches in plural stages in a range from the inlet opening 11 to the outlet opening 12, thereby forming a plurality of sound wave guide paths extending from the inlet opening 11 to the outlet opening 12.

26 Claims, 14 Drawing Sheets

U.S. PATENT DOCUMENTS 5,285,025 A * 2/1994 Yoshioka ..... 181/192
5,524,062 A * 6/1996 Oh ..... 381/338
5,900,593 A * 5/1999 Adamson ..... 181/152
5,925,856 A * 7/1999 Meyer et al. ..... 181/152
6,343,133 B1 * 1/2002 Adamson ..... 381/340
6,668,969 B2 * 12/2003 Meyer et al. ..... 181/177
7,044,265 B2 * 5/2006 Murphy ..... 181/192
7,177,437 B1 * 2/2007 Adams ..... 381/340
7,278,513 B2 * 10/2007 Brawley, Jr. ..... 181/176
2002/0014368 A1 * 2/2002 Adamson ..... 181/182

* cited by examiner

SOUND WAVE GUIDE STRUCTURE FOR SPEAKER SYSTEM AND HORN SPEAKER

The present application claims the benefit of priority of International Patent Application No. PCT/JP2004/004232 filed on Mar. 25, 2004, which application claims priority of Japanese Patent Application No. 2003-82899 filed Mar. 25, 2003. The entire text of the priority application is incorporated herein by reference in its entirety.

TECHNICAL FIELD

The present invention relates to a sound wave guide structure for a speaker system that is configured to guide a sound wave along predetermined paths to thereby control a wavefront of the sound wave emitted from the paths, and a horn speaker in which the sound wave guide structure is applied to a throat portion thereof.

BACKGROUND ART

Attempts have been made to adjust a path of a sound wave before emitted from an outlet opening in a speaker system. For example, in a sound wave guide path formed around an internal element provided inside a housing having an outlet opening of a slit shape, all shortest paths extending from an inlet opening to the outlet opening are configured to have a substantially equal length. Thereby, the sound wave is emitted from the outlet opening entirely in isophase to form a wavefront (isophase plane) of a rectangular planar shape (see e.g., specification of U.S. Pat. No. 5,163,167).

However, since it is difficult to design the sound wave guide path so that the wavefront of the emitted sound wave has shapes other than a rectangle, for example, a concave curved plane shape or a convex curved plane shape, and it is necessary to provide the internal element, the number of components increases and a manufacturing step becomes complicated. Furthermore, such a structure is intricate.

DISCLOSURE OF THE INVENTION

An object of the present invention is to provide a sound wave guide structure for a speaker system that is capable of, using a relatively simple structure, emitting a sound wave in isophase by causing substantially all transmission paths of the sound wave to have an equal length, and of emitting a sound wave having a wavefront of a concave curved plane shape or of a convex curved plane shape, i.e., controlling the wavefront of the emitted sound wave as desired and correctly.

In order to solve the above mentioned problems, a sound wave guide structure for a speaker system of the present invention comprises: a sound passage space connecting an inlet opening to an outlet opening; the sound passage space being configured to branch in plural stages in a range from the inlet opening to the outlet opening to form a plurality of sound wave guide paths extending from the inlet opening to the outlet opening.

In accordance with such a structure, each sound wave guide path extends from the inlet opening to the outlet opening while passing through branch points. Since the sound wave is transmitted to pass through the respective branch points, transmission paths of the sound wave are defined, and hence all the transmission paths of the sound wave can be anticipated substantially perfectly. As a result, the wave front of the sound wave can be controlled correctly using a simple structure.

In the sound wave guide structure for a speaker system, the plurality of sound wave guide paths may extend in a line shape from the inlet opening to the outlet opening. Since the sound wave guide paths extend in a line shape, the sound wave may be assumed to be transmitted along center axes of the paths, and therefore, the transmission paths of the sound wave can be recognized more correctly.

In the sound wave guide structure for a speaker system, center axes of the plurality of sound wave guide paths may be included in a flat plane, a curved plane or a bent plane. By causing the center axes of the sound wave guide paths to be included in the flat plane, the wave sound guide structure for the speaker system can be easily manufactured. By way of example, the sound passage space may be formed in such a manner that two components that are symmetric with respect to a flat plane which is a joint surface are joined to each other at the joint surface. Also, by causing the center axes to be included in the curved plane or the bent plane, the sound wave guide structure for the speaker system can be entirely small-sized.

In the sound wave guide structure for a speaker system, the outlet opening may have a slit shape, and the sound wave guide path may branch at respective branch points in a longitudinal direction of a slit of the outlet opening.

In the sound wave guide structure for a speaker system, the outlet opening of the slit shape may extend in a straight line shape.

In the sound wave guide structure for a speaker system, the outlet opening of the slit shape may extend to be curved in a convex curved line shape.

In the sound wave guide structure for a speaker system, the outlet opening of the slit shape may extend to be curved in a convex circular arc shape.

In the sound wave guide structure for a speaker system, the outlet opening of the slit shape may extend to be curved in a concave curved line shape.

In the sound wave guide structure for a speaker system, the outlet opening of the slit shape may extend to be curved in a concave circular arc shape.

In the sound wave guide structure for a speaker system, almost all of the plurality of sound wave guide paths may have a substantially equal path length. Thereby, the sound wave is emitted in isophase from an entire outlet opening.

In the sound wave guide structure for a speaker system, the sound wave guide path having an outlet at a position closer to a center of the outlet opening of the slit shape may have a shorter path length.

In the sound wave guide structure for a speaker system, the sound wave guide path having an outlet at a position closer to a center of the outlet opening of the slit shape may have a longer path length.

In the sound wave guide structure for a speaker system, the path length may be defined along a line passing through a middle point in a width direction of the path just after the branch point. Thereby, the wavefront of the sound wave emitted from the outlet opening can be controlled more precisely.

In the sound wave guide structure for a speaker system, at least part of at least one of the plurality of sound wave guide paths may extend in a curved line shape. Thereby, the sound wave guide paths are designed not to include sharply bent regions.

In the sound wave guide structure for a speaker system, at least part of at least one of the plurality of sound wave guide paths may extend in a S shape. Thereby, the sound wave guide paths are designed not to include sharply bent regions.

In the sound wave guide structure for a speaker system, at least one of the plurality of sound wave guide paths may have a largest height in an intermediate region between the inlet opening and the outlet opening of the sound passage space. Thereby, the sound wave guide paths are designed not to include extremely wide regions.

In the sound wave guide structure for a speaker system, the sound wave guide path may have the largest height at the branch point thereof or in the vicinity of the branch point. Thereby, the branch points of the sound passage space are designed not to have extremely wide regions.

In the sound wave guide structure for a speaker system, the sound wave guide paths may extend from the branch point may merge at a merge point.

The sound wave guide structure for a speaker system may be applied to a throat portion of a horn speaker.

The above and further objects, features and advantages of the invention will be more fully be apparent from the following detailed description with the accompanying drawings

BEST MODE FOR CARRYING OUT THE INVENTION

Embodiments of the present invention will be described with reference to the drawings. First of all, a basic structure of a horn speaker in which a sound wave guide structure for a speaker system according to an embodiment of the present invention is employed in a throat portion thereof will be described with reference to FIGS. 1 through 3.

Figure 1C:
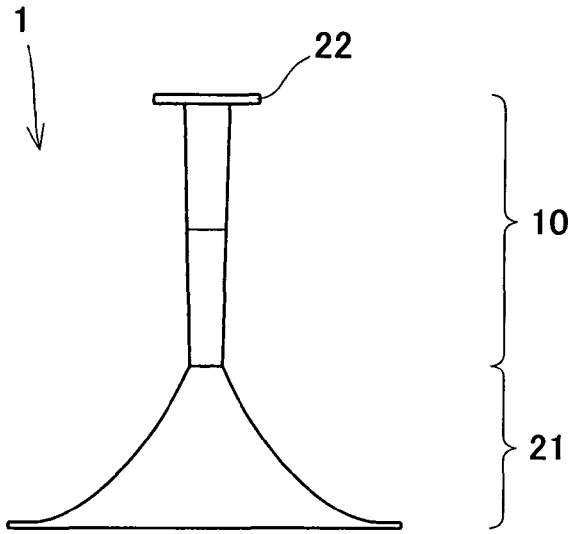
FIGS. 1(*a*), 1(*b*), and 1(*c*) are a front view, a right side view, and a plan view of a horn speaker in which a sound wave guide structure for a speaker system of the present invention is employed in a throat portion thereof.
Figure 1A:
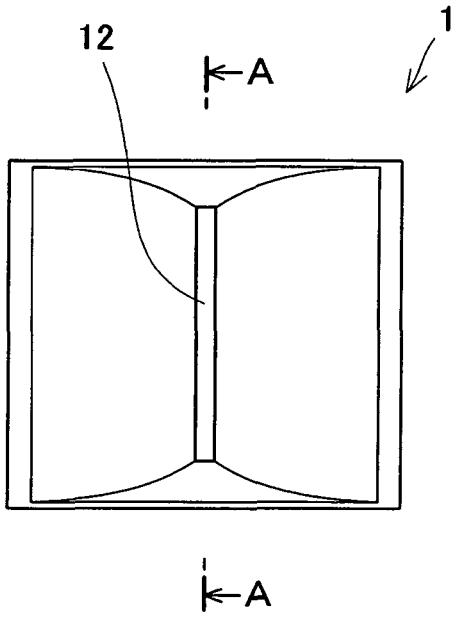
Figure 1B:
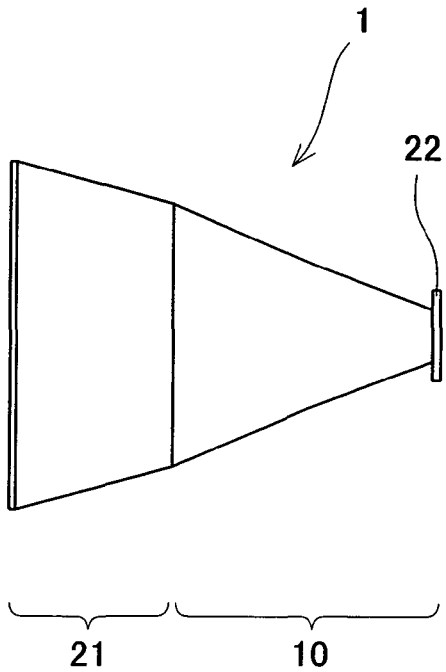

FIGS. 1(*a*), 1(*b*), and 1(*c*) are a front view, a right side view, and a plan view of a horn speaker 1. The horn speaker 1 has a structure that is symmetric in a rightward and leftward direction and in an upward and downward direction. The horn speaker 1 is mainly comprised of a throat portion 10 and a horn portion 21. The horn speaker 1 of this type is used with a driver unit attached thereto and is capable of obtaining a constant directivity over a relatively wide frequency range.

The throat portion 10 is provided with a circular flange 22 at a base end thereof. By the flange 22, the drive unit is attached to the throat portion 10. A tip end of the throat portion 10 is connected to the base end of the horn portion 21. In the front view of FIG. 1(*a*), a slit of a longitudinally elongate rectangular shape is illustrated in a substantially center section. This slit is an outlet opening 12 of the throat portion 10.

Figure 2:
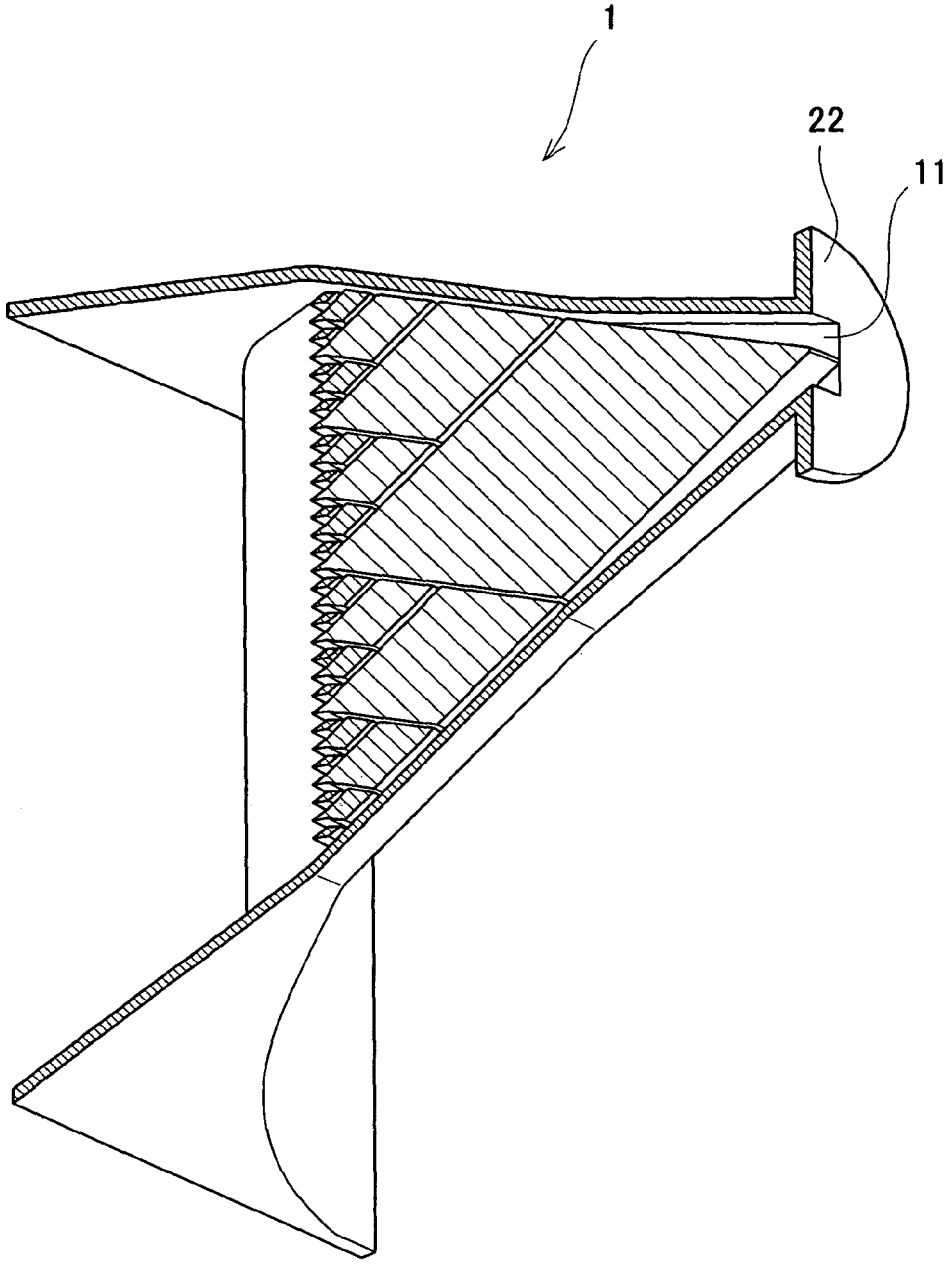
FIG. 2 is a longitudinal sectional view of the horn speaker of FIG. 1, as seen from obliquely downward.
Figure 3:
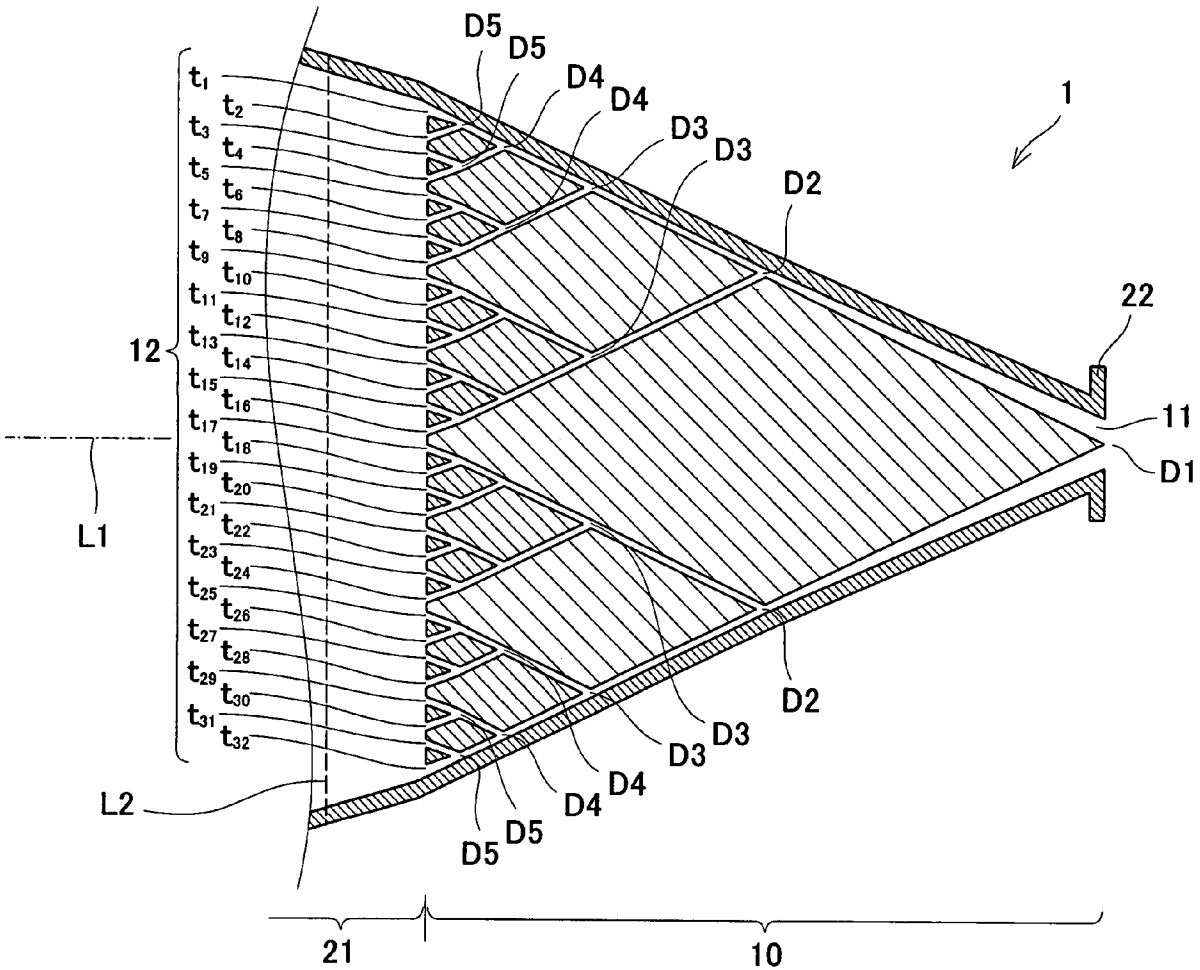
FIG. 3 is a cross-sectional view taken in the direction of arrows along line A-A in FIG. 1(*a*)

FIG. 2 is a longitudinal sectional view of the horn speaker 1, as seen from obliquely downward. The cross-section of FIG. 2 is a cross-sectional view taken in the direction of arrows line A-A in FIG. 1(*a*). FIG. 3 is a cross-sectional view taken in the direction of arrows along line A-A in FIG. 1(*a*). It shall be appreciated that in FIG. 3, a tip end portion of the horn portion 21 that should be illustrated on the left side of the FIG. 3 is omitted.

As can be seen from FIGS. 2 and 3, the flange 22 is provided at the base end of the throat portion 10. An inlet opening 11 is formed on the flange 22. The outlet opening 12 of a slit shape is provided at the tip end of the throat portion 10, and the throat portion 10 is connected to the horn portion 21 at the outlet opening 12. And, a sound passage space is formed to extend in a range from the base end to the tip end of the throat portion 10.

The sound passage space includes paths configured to branch in plural stages. Each branch path extends in a line shape. The sound passage space entirely has such a structure as a branching tree extending to the tip end.

The sound passage space branches into two branch paths at the base end (inlet opening 11). Each of the two branch paths branches into two branch paths at a substantially middle point between the base end and the tip end. Each of these branch paths further branches toward the tip end to be connected to the outlet opening 12 of the slit shape at the tip end. At the respective branch points, each path branches in a longitudinal direction of the outlet opening 12 of the slit shape.

One path branches into two paths in five stages in the range from the base end to the tip end. Thereby, the sound passage space has thirty two outlets t1 to t32 at the tip end. In other words, there are thirty two paths (sound wave guide paths) in the range from the base end to the tip end.

A center axis L1 of the horn speaker 1 conforms to a forward and backward direction of the horn speaker 1. The outlet opening 12 at the tip end forms a slit extending in the upward and downward direction as shown in FIG. 3. The thirty two paths (paths extending from the inlet opening 11 at the base end to the outlet opening 12 at the tip end) include five branch points.

A first branch point D1 is located at the base end of the throat portion 10. The path branches at the branch point D1 to be tilted to form an approximately 30 degrees upward and downward with respect to the center axis L1 of the horn speaker 1.

At a second branch point D2 that is located at a substantially middle point between the base end and the tip end of the throat portion 10, the path branches to be tilted to form an approximately 30 degrees upward and downward with respect to the center axis L1.

At a third branch point D3 that is located at a substantially middle point between the second branch point D2 and the tip end of the throat portion 10, the path branches to be tilted to form an approximately 30 degrees upward and downward with respect to the center axis L1.

At a fourth branch point D4 that is located at a substantially middle point between the third branch point D3 and the tip end of the throat portion 10, the path branches to be tilted to form an approximately 30 degrees upward and downward with respect to the center axis L1.

At a fifth branch point D5 that is located at a substantially middle point between the fourth branch point D4 and the tip end of the throat portion 10, the path branches to be tilted to form an approximately 30 degrees upward and downward with respect to the center axis L1.

The sound passage space of the throat portion 10 is provided with thirty one branch points as a whole, including one first branch point D1, two second branch points D2, four third branch points D3, eight fourth branch points D4, and sixteen fifth branch points D5, although only part of them are represented by reference designators in FIG. 3.

Since the sound passage space is thus structured, the thirty two paths (sound wave guide paths) extending from the inlet opening 11 to outlets t1 to t32 have a substantially equal path length. Therefore, when the driver unit is attached to the flange 22 and is driven, the sound wave is emitted in isophase from the entire outlet opening 12 of the slit shape so as to form a planar rectangular wavefront (isophase plane of the sound wave). In FIG. 3, a broken line L2 schematically represents the wavefront of the sound wave that has just been emitted from the outlet opening 12 (thirty two outlets t1 to t32).

Since the sound passage space has the branch structure, the center axes of the paths have a similar branch structure. As can be seen from FIGS. 1(*a*) to 1(*c*) to 3, the center axes of the thirty two paths (sound wave guide paths) are included in a flat plane that is identical to a flat plane of FIG. 3. By configuring the sound passage space so that all the center axes are included in the flat plane, the throat portion 10 is configured in planar shape, and hence is easily manufactured. For example, one horn speaker may be constructed of two components of the shape in FIG. 2 which are joined to each other. Because of the use of the components having an identical shape, a mold cost can be reduced. Alternatively, rather than the entire horn speaker, only the throat portion may be constructed of two components having an identical shape which are joined to each other.

Thus far, the structure of the horn speaker 1 that employs the sound wave guide structure according to the embodiment of the present invention in the throat portion 10 has been described with reference to FIGS. 1 to 3.

Subsequently, a structure of a horn speaker that employs a configuration of another embodiment of the present invention in a throat portion thereof will be described with reference to FIG. 4.

In the horn speaker 1 shown in FIGS. 1(*a*) to 1(*c*) to 3, all the center axes of the thirty two paths (sound wave guide paths) are included in one flat plane. Alternatively, all the center axes of these paths may be included in a curved plane or a bent plane. FIG. 4(*a*) is a plan view of a horn speaker 31 configured to include all the center axes of the sound wave guide paths in the curved plane and FIG. 4(*b*) is a plan view of a horn speaker 32 configured to include all the center axes of the sound wave guide paths in the bent plane. In FIGS. 4(*a*) and 4(*b*), broken lines L32 and L34 represent the planes including the center axes of the paths. The horn speakers 31 and 32 in FIGS. 4(*a*) and 4(*b*) are identical in structure to the horn speaker 1 of FIGS. 1 to 3 except that all the center axes of the paths (sound wave guide paths) of the horn speaker 1 are included in the flat plane and all the center axes of the paths of the horn speakers 31 and 32 are included in the curved plane and the bent plane.

Figure 4B:
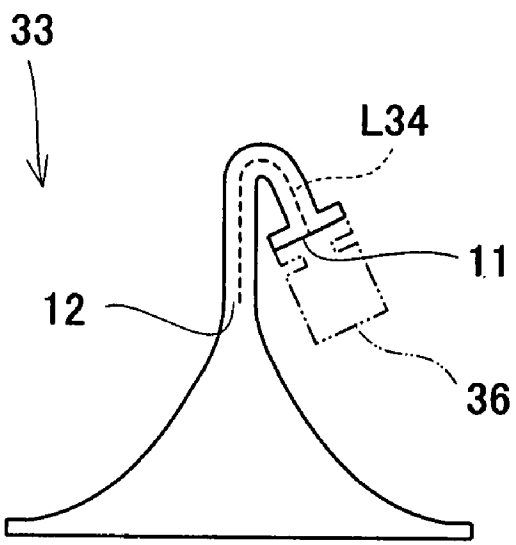
FIG. 4(*a*) is a plan view of the horn speaker configured to include all center axes of sound wave guide paths in a curved plane and FIG. 4(*b*) is a plan view of the horn speaker configured to include all center axes of the sound wave guide paths in a bent plane.
Figure 4A:
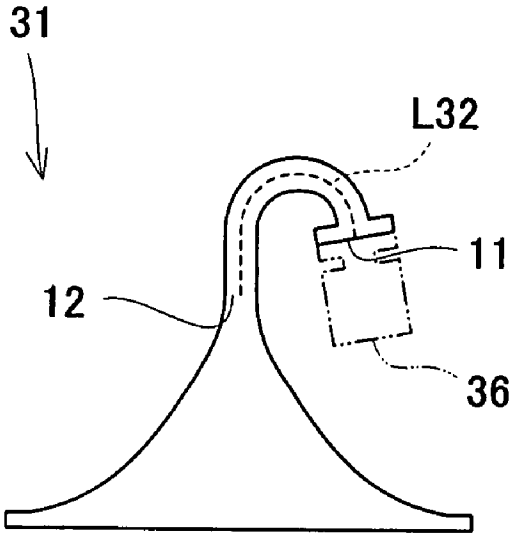

As can be seen from FIGS. 4(*a*) and 4(*b*), by configuring the sound wave guide paths so that all the center axes of the paths are included in the curved plane or the bent plane, the whole length of the throat portion can be reduced. In particular, by orienting the inlet opening 11 of the sound passage space of the throat portion 10 substantially in the same direction as that of the outlet opening 12, as illustrated in the horn speakers 31 and 33 of FIGS. 4(*a*) and 4(*b*), a driver unit 36 does not protrude backward from the horn speakers 31 and 32. This reduces the size of an entire speaker system.

Thus far, the structures of the horn speakers 31 and 33 that employ the configuration of another embodiment of the present invention in the throat portions thereof have been described with reference to FIGS. 4(*a*) to 4(*c*).

Figure 5A:
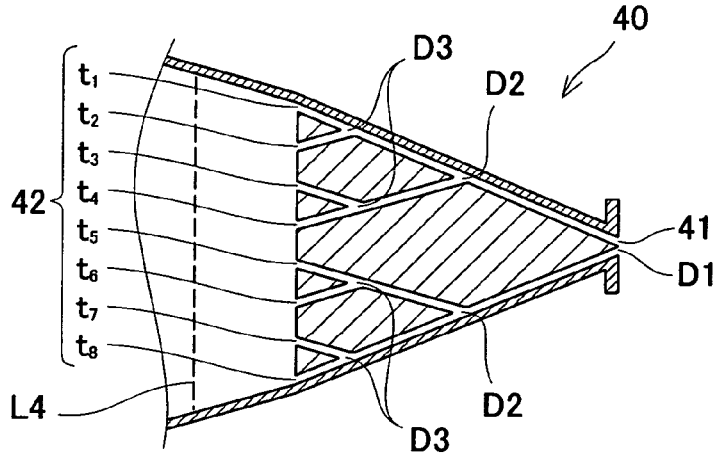
FIGS. 5(*a*) to 5(*c*) are longitudinal sectional views of the throat portions of the horn speakers, FIGS. 5(*a*) to (*c*) showing various configurations of the sound passage space.
Figure 5B:
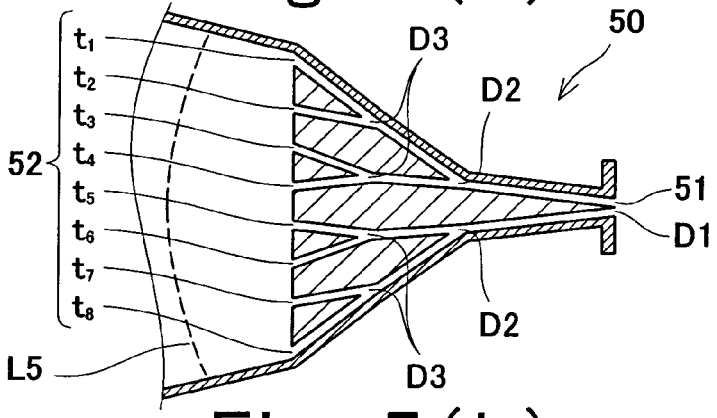
Figure 5C:
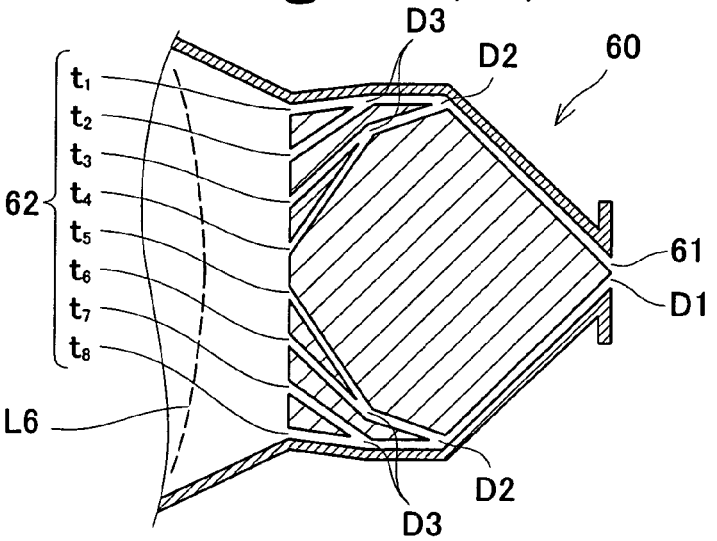

Subsequently, structures of horn speakers 40, 50, and 60 that employ configurations of another embodiments of the present invention in throat portions thereof will be described with reference to FIGS. 5(*a*) to 5(*c*). FIGS. 5(*a*) to 5(*c*) are longitudinal sectional views of the throat portions of the horn speakers 40, 50, and 60.

As in the sound passage space of FIG. 3, the sound passage space formed in the throat portion thereof in FIG. 5(*a*) is configured such that all paths have a substantially equal path length. Specifically, one path branches into two paths at the respective branch points D1, D2, and D3.

At the first to third branch points D1, D2, and D3, the path branches to be tilted to form an approximately 30 degrees upward and downward with respect to a rightward and leftward direction of FIG. 5. This makes it possible that eight paths (paths extending from an inlet opening 41 to outlets t1 to t8) forming the sound passage space have an equal path length. Therefore, the sound wave is emitted in isophase from an entire outlet opening 42 of a slit shape so as to form a planar rectangular wavefront (isophase plane of the sound wave). In FIG. 5(*a*), a broken line L4 schematically represents the wavefront of the sound wave that has just been emitted from the outlet opening 42 (eight outlets t1 to t8). Such a structure can minimize a directivity angle of the horn speaker 40.

The sound passage space formed in the throat portion of FIG. 5(*b*) is configured in such a manner that a path having an outlet at a location closer to a center of an outlet opening 52 of a slit shape has a shorter length. In other words, the sound passage space is configured such that paths extending from the inlet opening 51 to outlets t4 and t5 have a shortest length and paths extending from an inlet opening 51 to outlets t1 and t8 have a longest length. As shown in FIG. 5(*b*), positions of the second branch points D2 in the upward and downward direction substantially conform to positions of the outlets t4 and t5 in the upward and downward direction.

Such a structure of the throat portion causes the wavefront (isophase plane of sound wave) at the outlet opening 52 of the slit shape to have a convex curved plane shape. In FIG. 5(*b*), a broken line L5 schematically shows the wavefront of the sound wave that has just been emitted from the outlet opening 52 (eight outlets t1 to t8).

The sound passage space formed in the throat portion of FIG. 5(*c*) is configured in such a manner that a path having an outlet at a location closer to a center of an outlet opening 62 of a slit shape has a longer length. In other words, the sound passage space is configured such that paths extending from an inlet opening 61 to outlets t4 and t5 have a longest length and paths extending from the inlet opening 61 to outlets t1 and t8 have a shortest length. As shown in FIG. 5(*c*), positions of the second branch points D2 in the upward and downward directions substantially conform to positions of outlets t1 and t8 in the upward and downward direction.

Such a structure of the throat portion causes the wavefront (isophase plane of sound wave) at the outlet opening 62 of the slit shape to have a concave curved plane shape. In FIG. 5(*c*), a broken line L6 schematically shows the wavefront of the sound wave that has just been emitted from the outlet opening 62 (eight outlets t1 to t8).

As should be appreciated from FIGS. 5(*a*) to 5(*c*), the wavefront can be controlled to have various shapes by varying the structure of the branch paths forming the sound passage space. In other words, a curvature of the wavefront or the directivity angle can be easily controlled.

Thus far, the structures of horn speakers 40, 50, and 60 that employ configurations of another embodiments of the present invention in the throat portions thereof have been described with reference to FIGS. 5(*a*) to 5(*c*).

Figure 6:
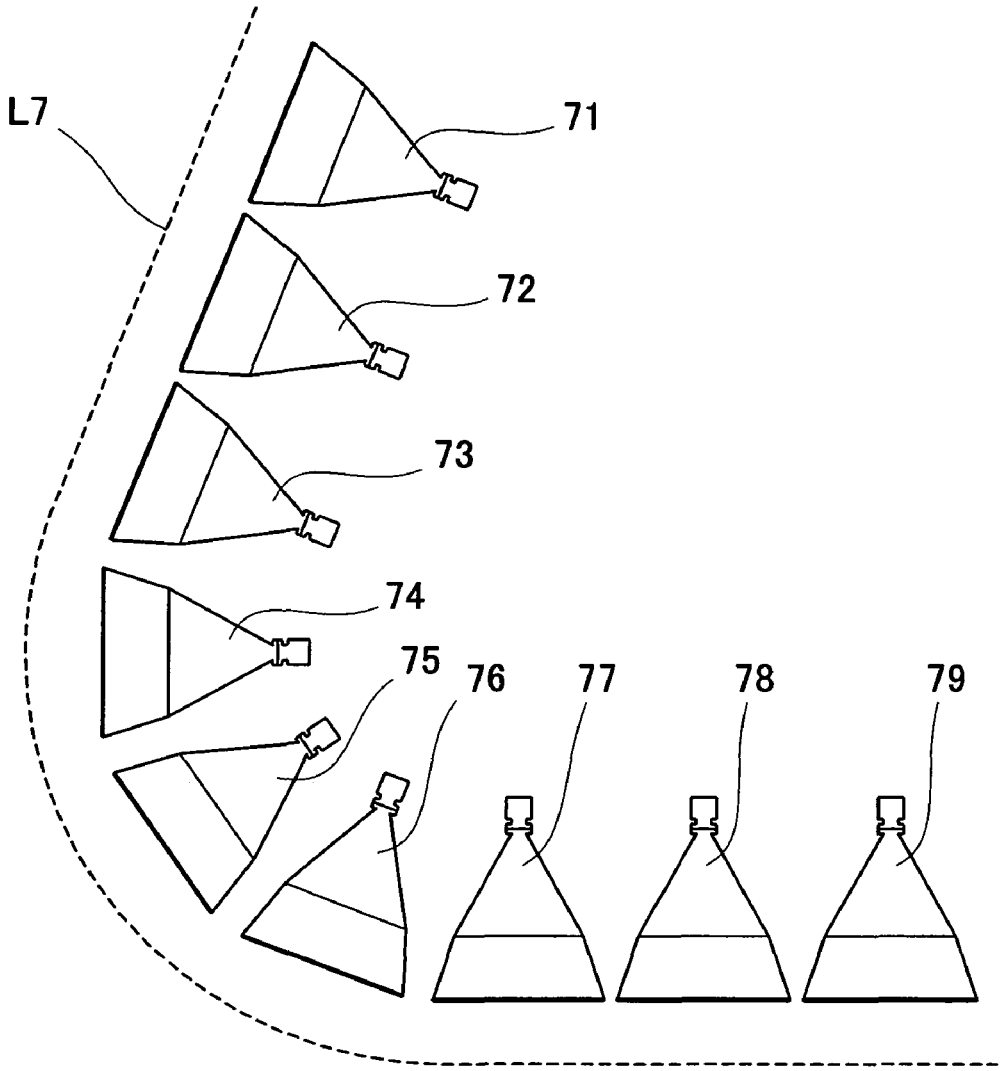
FIG. 6 is a view showing an example of how the horn speaker according to the present invention is used.

Subsequently, an example of how the horn speakers that employ the embodiments of the present invention in the throat portions thereof will be described with reference to FIG. 6. FIG. 6 shows an acoustic system in which a plurality of (nine) horn speakers 71 to 79 are arranged in a line shape to be adjacent to each other. In this system, some of the plurality of horn speakers are arranged in a straight line shape and others are arranged in a curved line shape. Horn speakers 71 to 73 and 77 to 79 arranged in the straight line shape are horn speakers including the throat portions having the structures of FIG. 5(*a*). Horn speakers 74 to 76 arranged in the curved line shape are horn speakers including the throat portions having the structures of FIG. 5(*b*).

Conceptually, the sound wave having the wavefront of the flat plane shape is emitted from each of the horn speakers 71 to 73 and 77 to 79, while the sound wave having the wavefront of the convex curved plane is emitted from each of the horn speakers 74 to 76. In the entire acoustic system constructed of the horn speakers 71 to 79, a wavefront that is substantially similar to the shape of arrangement configuration of the horn speakers 71 to 79 is obtained, as indicated by a broken line L7 of FIG. 6. Thereby, phase interference between adjacent horn speakers, in particular phase interference in a high frequency band, can be avoided.

Figure 7:
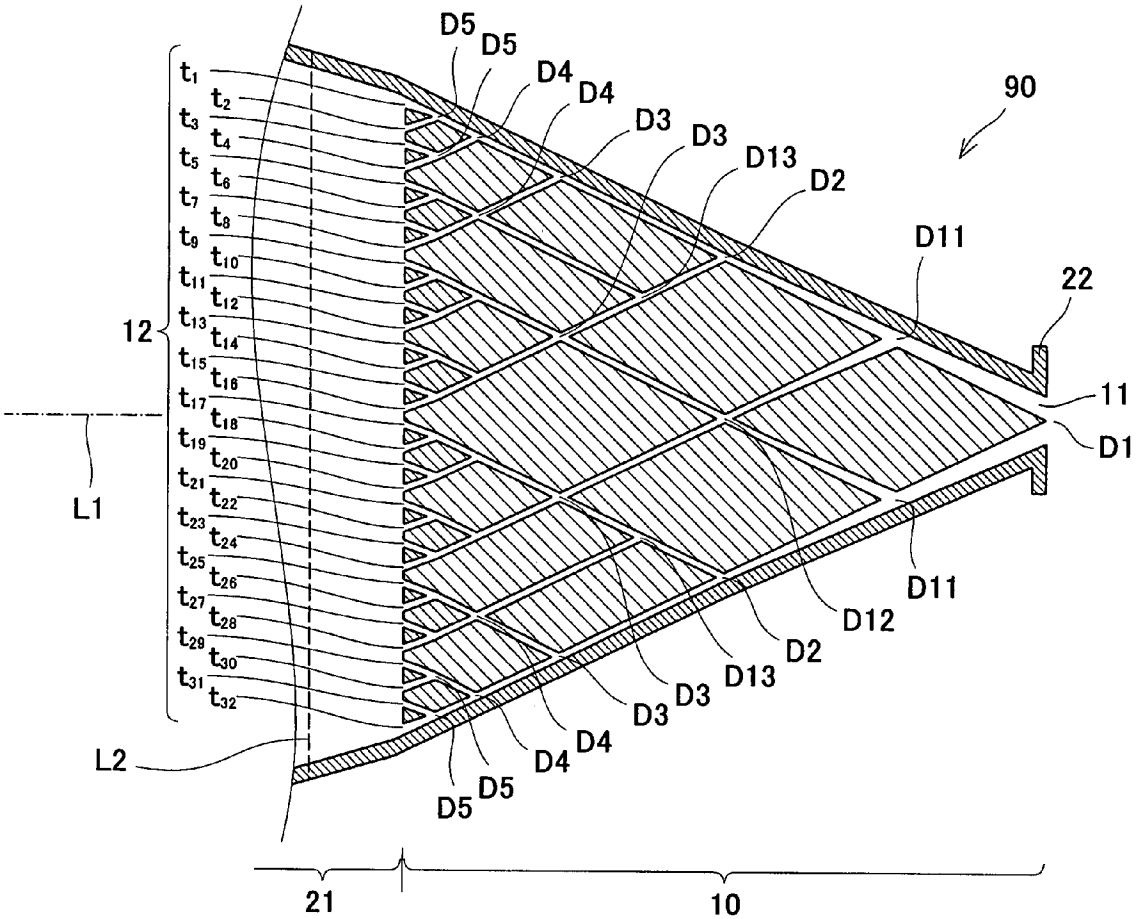
FIG. 7 is a longitudinal sectional view of the horn speaker.

Subsequently, a basic structure of a horn speaker 90 which employs a sound wave guide structure for a speaker system according to another embodiment of the present invention in a throat portion thereof will be described with reference to FIG. 7. FIG. 7 is a longitudinal sectional view of the horn speaker 90. In FIG. 7, a tip end portion of a horn portion 21 that should be illustrated on the left side of FIG. 7 is omitted.

The horn speaker 90 is substantially identical in structure to that of the horn speaker 1 of FIGS. 1 to 3 except for a branch configuration of the sound passage space in the throat portion 10.

The branch configuration of the sound passage space of the throat portion 10 of the horn speaker 90 is somewhat intricate as compared to the branch configuration of the sound passage space of FIG. 3. Specifically, branch points D11 are each formed between the branch point D1 and the branch point D2. A merge point D12 is formed at a location where the paths extending from the branch points D11, toward inside of the horn speaker 90, and to the branch points D3 merge. These paths merge at the merge point D12 and then further branch in two directions. That is, the point D12 is the branch point and the merge point.

Branch points D13 are each further provided between the branch point D2 and the branch point D3. One of the paths extending from the branch point D13 merges into another path at the branch point D3 and the other merges into another path at a branch point D4. In other words, two of the four branch points D3, which are located on the inner side, are the branch points and the merge points. Also, two of the eight branch points D4 are the branch points and the merge points.

Since the horn speaker 90 is thus constructed, all the paths extending from the inlet opening 11 to the outlets t1 to t32 while branching and merging have a substantially equal path length. Therefore, when the driver unit is attached to the flange 22 and is driven, the sound wave is emitted in isophase from the entire outlet opening 12 of the slit shape.

Figure 8A:
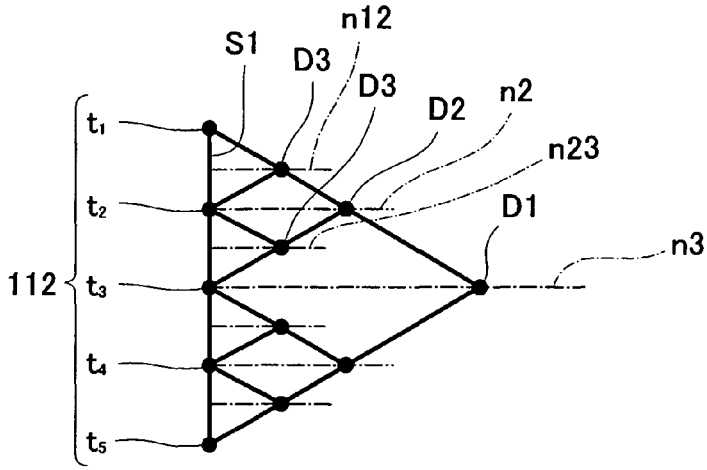
FIGS. 8(*a*) to 8(*c*) are schematic views of sound passage space, illustrating examples of design methods of the sound passage space.
Figure 8B:
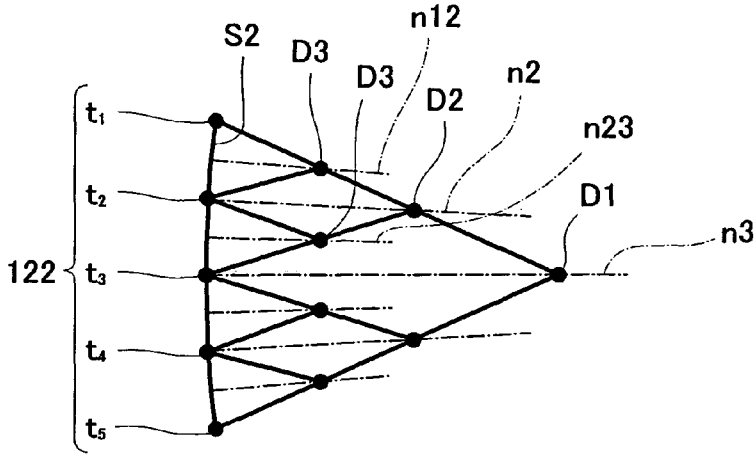
Figure 8C:
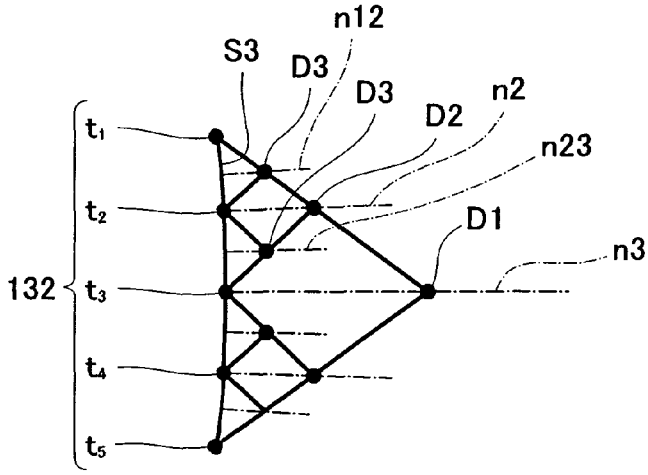

Subsequently, an example of a design method of the sound passage space will be described. FIGS. 8(*a*) to 8(*c*) are schematic views of sound passage spaces, illustrating examples of design methods of the sound passage space. FIG. 8(*a*) shows the sound passage space of the sound wave guide structure in which an outlet opening 112 has a slit shape extending in a straight line shape. FIG. 8(*b*) shows the sound passage space of the sound wave guide structure in which an outlet opening 122 has a slit shape extending to be curved in a convex curved line shape. FIG. 8(*c*) shows the sound passage space of the sound wave guide structure in which an outlet opening 132 has a slit shape extending to be curved in a concave curved line shape. More specifically, the slit of the outlet opening 122 of FIG. 8(*b*) extends to be curved in a convex circular arc shape and the slit of the outlet opening 132 of FIG. 8(*c*) extends to be curved in a concave circular arc shape.

First of all, with reference to FIG. 8(*a*), the design method of the sound wave guide structure in which the outlet opening 112 has a slit shape extending in the straight line shape will be described.

Initially, positions of the outlets (outlet t1 and outlet t5) at both ends of the outlet opening 112 are determined. The outlet opening 112 of the slit shape is defined along a straight line S1 connecting the outlet t1 to the outlet t5.

Then, a position of the outlet t3 is determined on a point that bisects the straight line S1 connecting the outlet t1 to the outlet t5. Then, a position of the outlet t2 is determined on a point that bisects a straight line connecting the outlet t1 to the outlet t3. Then, a position of the outlet t4 is determined on a point that bisects a straight line connecting the outlet t3 to the outlet t5. In this manner, the five outlets t1, t2, t3, t4, and t5 are positioned at equal intervals on the straight line S1.

Then, a position of the first branch point D1 is determined on an arbitrary point of a normal line n3 extending to pass through the outlet t3 and to cross the straight line S1 at a right angle.

Then, a position of the second branch point D2 is determined on an intersection at which a normal line n2 extending to pass through the outlet t2 and to cross the straight line S1 at a right angle intersects a straight line connecting the branch point D1 to the outlet t1.

Then, a position of the third branch point D3 (highest third branch point D3) is determined on a intersection at which a normal line n12 extending to pass through a point that bisects a straight line connecting the outlet t1 to the outlet t2 and to cross the straight line S1 at a right angle intersects a straight line connecting the branch point D2 to the outlet t1. Likewise, a position of the third branch point D3 (second highest third branch point D3) is determined on a intersection at which a normal line n23 extending to pass through a point that bisects a straight line connecting the outlet t2 to the outlet t3 and to cross the straight line S1 at a right angle intersects a straight line connecting the branch point D2 to the outlet t3.

In the manner described above, four sound wave guide paths in a region above the normal line n3 in FIG. 8(*a*) are defined. The four sound wave guide paths are a first path extending in a straight line shape from the branch point D1 to the outlet t1, a second path extending in a straight line shape from the branch point D1 to the highest third branch point D3 and bent at this branch point D3 to extend to the outlet t2, a third path extending from the branch pint D1 to the second branch point D2, bent at this branch point D2 to extend to the second highest third branch point D3, and bent at this branch point D3 to extend to the outlet t2, and a fourth path extending from the branch point D1 to the second branch point D2, bent at this branch point D2 to extend in a straight line shape to the outlet t3. The second path and the third path merge at the outlet t2.

In the manner in which the four paths are defined in the region above the normal line n3, four paths are defined in a region below the normal line n3 in FIG. 8(*a*).

In this manner, the sound passage space is designed to have eight sound wave guide paths having an equal path length.

Since the outlet opening 112 has the slit shape extending in a straight line shape and the eight sound waveguide paths have an equal path length, the sound wave emitted from the outlet opening 112 has a wavefront of a straight line shape.

Thus far, the design method of the sound wave guide structure in which the outlet opening 112 has the slit shape extending in the straight line shape has been described with reference to FIG. 8(*a*).

Secondly, the design method of the sound wave guide structure in which the outlet opening 122 has the slit shape extending to be curved in the convex circular arc shape will be described with reference to FIG. 8(*b*).

Initially, the outlet opening 122 of the convex circular arc shape is defined. The outlet opening 122 of FIG. 8(*b*) has a convex circular arc shape with a center angle of 15 degrees. Then, positions of outlets (outlet t1 and outlet t5) at both ends of the outlet opening 122 are determined. The outlet t1 and the outlet t5 are coupled to each other by a circular arc S2.

Then, a position of the outlet t3 is determined on a point that bisects the circular arc S2 connecting the outlet t1 to the outlet t5. Then, a position of the outlet t2 is determined on a point that bisects a circular arc connecting the outlet t1 to the outlet t3. Then, a position of the outlet t4 is determined on a point that bisects a circular arc connecting the outlet t3 to the outlet t5. In this manner, the five outlets t1, t2, t3, t4, and t5 are positioned at equal intervals on the circular arc S2.

Then, a position of the first branch point D1 is determined on an arbitrary point of a normal line n3 extending to pass through the outlet t3 and to cross the circular arc S2 at a right angle.

Then, a position of the second branch point D2 is determined on an intersection at which a normal line n2 extending to pass through the outlet t2 and to cross the circular arc S2 at a right angle intersects a straight line connecting the branch point D1 to the outlet t1.

Then, a position of the third branch point D3 (highest third branch point D3) is determined on a intersection at which a normal line n12 extending to pass through a point that bisects a circular arc connecting the outlet t1 to the outlet t2 and to cross the circular arc S2 at a right angle intersects a straight line connecting the branch point D2 to the outlet t1. Likewise, a position of the third branch point D3 (second highest third branch point D3) is determined on a intersection at which a normal line n23 extending to pass through a point that bisects a circular arc connecting the outlet t2 to the outlet t3 and to cross the circular arc S2 at a right angle intersects a straight line connecting the branch point D2 to the outlet t3.

In the manner described above, four sound wave guide paths in a region above the normal line n3 in FIG. 8(*b*) are defined. The four sound wave guide paths are a first path extending in a straight line shape from the branch point D1 to the outlet t1, a second path extending in a straight line shape from the branch point D1 to the highest third branch point D3 and bent at this branch point D3 to extend to the outlet t2, a third path extending from the branch point D1 to the second branch point D2, bent at this branch point D2 to extend to the second highest third branch point D3, and bent at this branch point D3 to extend to the outlet t2, and a fourth path extending from the branch point D1 to the second branch point D2 and bent at this branch point D2 to extend in a straight line shape to the outlet t3. The second path and the third path merge at the outlet t2.

In the manner in which the four paths are defined in the region above the normal line n3, four paths are defined in a region below the normal line n3 in FIG. 8(*b*).

In this manner, the sound passage space is designed to have eight sound wave guide paths having an equal path length.

Since the outlet opening 122 has the slit shape extending to be curved in the convex circular arc shape and the eight sound wave guide paths have an equal path length, the sound wave emitted from the outlet opening 122 has a wavefront of a convex circular arc shape similar to the shape of the outlet opening 122.

Thus far, the design method-of the sound wave guide structure in which the outlet opening 122 has the slit shape extending to be curved in the convex circular arc shape has been described with reference to FIG. 8(*b*).

Thirdly, with reference to FIG. 8(*c*), the design method of the sound wave guide structure in which the outlet opening 132 has the slit shape extending to be curved in the concave circular arc shape will be described.

Initially, the outlet opening 132 of the concave circular arc shape is defined. The outlet opening 132 of FIG. 8(*c*) has a concave circular arc shape with a center angle of 15 degrees. Then, positions of outlets (outlet t1 and outlet t5) at both ends of the outlet opening 132 are determined. The outlet t1 and the outlet t5 are coupled to each other by a circular arc S3.

Then, a position of the outlet t3 is determined on a point that bisects the circular arc S3 connecting the outlet to the outlet t5. Then, a position of the outlet t2 is determined on a point that bisects a circular arc connecting the outlet t1 to the outlet t3. Then, a position of the outlet t4 is determined on a point that bisects a circular arc connecting the outlet t3 to the outlet t5. In this manner, the five outlets t1, t2, t3, t4, and t5 are positioned at equal intervals on the circular arc S3.

Then, a position of the first branch point D1 is determined on an arbitrary point of the normal line n3 extending to pass through the outlet t3 and to cross the circular arc S3 at a right angle.

Then, a position of the second branch point D2 is determined on an intersection at which the normal line n2 extending to pass through the outlet t2 and to cross the circular arc S3 at a right angle intersects a straight line connecting the branch point D1 to the outlet t1.

Then, a position of the third branch point D3 (highest third branch point D3) is determined on a intersection at which the normal line n12 extending to pass through a point that bisects a circular arc connecting the outlet t1 to the outlet t2 and to cross the circular arc S3 at a right angle intersects a straight line connecting the branch point D2 to the outlet t1. Likewise, a position of the third branch point D3 (second highest third branch point D3) is determined on a intersection at which the normal line n23 extending to pass through a point that bisects a circular arc connecting the outlet t2 to the outlet t3 and to cross the circular arc S3 at a right angle intersects a straight line connecting the branch point D2 to the outlet t3.

In the manner described above, four sound wave guide paths in a region above the normal line n3 in FIG. 8(*c*) are defined. The four sound wave guide paths are a first path extending in a straight line shape from the branch point D1 to the outlet t1, a second path extending in a straight line shape from the branch point D1 to the highest third branch point D3 and bent at this branch point D3 to extend to the outlet t2, a third path extending from the branch point D1 to the second branch point D2, bent at this branch point D2 to extend to the second highest third branch point D3, and bent at this branch point D3 to extend to the outlet t2, and a fourth path extending from the branch point D1 to the second branch point D2 and bent at this branch point D2 to extend in a straight line shape to the outlet t3. The second path and the third path merge at the outlet t2.

In the manner in which the four paths are defined in the region above the normal line n3, four paths are defined in a region below the normal line n3 in FIG. 8(*c*).

In this manner, the sound passage space is designed to have eight sound wave guide paths having an equal path length.

Since the outlet opening 132 has the slit shape extending to be curved in the concave circular arc shape and the eight sound waveguide paths have an equal path length, the sound wave emitted from the outlet opening 132 has a wavefront of a concave circular arc shape similar to the shape of the outlet opening 132.

Thus far, the design method of the sound wave guide structure in which the outlet opening 132 has the slit shape extending to be curved in the concave circular arc shape has been described with reference to FIG. 8(*c*).

The sound passage space whose branch points are set according to the design method of FIGS. 8(*a*) to 8(*c*) have paths extending from the inlet opening (in the vicinity of the branch point D1 in the example of FIGS. 8(*a*) to 8(*c*)) to the outlet opening, which are shorter in length than those of sound passage space whose branch points are set at other locations. In other words, the design methods of FIGS. 8(*a*) to 8(*c*) are to design the sound passage space so that the paths extending from the inlet opening to the outlet opening have a shortest length.

Therefore, when the horn speaker in which the sound passage space designed according to this method is applied to the throat portion thereof is used in combination with another speaker, (for example, a woofer), a time lag with respect to the another speaker becomes minimum. In other words, the time lag can be corrected by using a delay device or the like with a minimum correction time (e.g., delay time set in the delay device).

Thus far, examples of the design method of the sound passage space have been described with reference to FIGS. 8(*a*) to 8(*c*).

Subsequently, an example of the design method of a shape of a path extending from one branch point to another branch point in a sound wave guide path considering a width of the path, will be described with reference to FIGS. 9(*a*) to 9(*c*) and FIGS. 13(*a*) and 13(*b*).

Figure 9A:
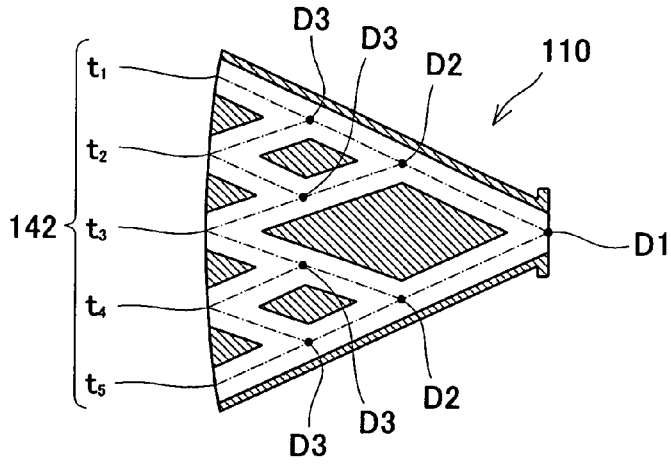
FIGS. 9(*a*) to 9(*c*) are longitudinal sectional views of throat portions having sound wave guide structures.
Figure 9B:
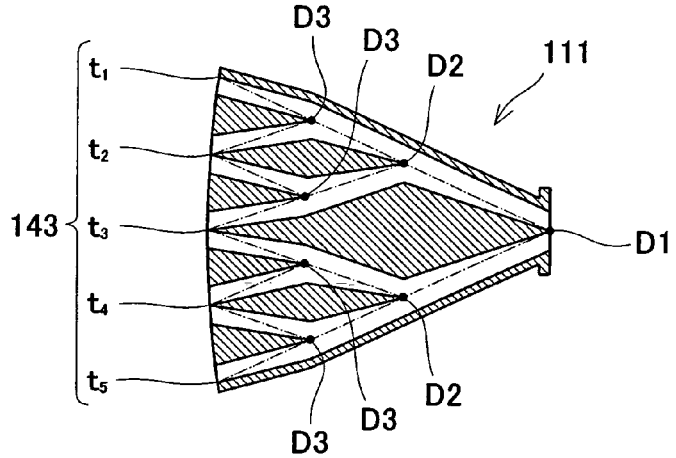
Figure 9C:
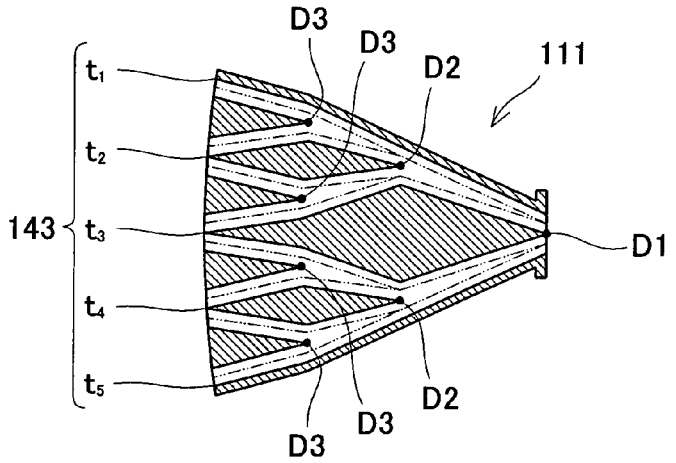

FIGS. 9(*a*) to 9(*c*) are longitudinal sectional views of throat portions 110 and 111 having sound wave guide structures, corresponding to, for example, the longitudinal sectional view of the throat portion 10 of FIG. 3.

The sound passage space of the throat portions 110 and 111 shown in FIGS. 9(*a*) to 9(*c*) basically have structures identical to that of FIG. 8(*b*). Therefore, outlet openings 142 and 143 have slit shapes extending to be curved in a convex circular arc shape.

FIG. 9(*a*) shows the longitudinal section of the throat portion 110. In FIG. 9(*a*), a dashed line indicates center lines of the sound wave guide paths. The center lines are designed according to a method similar to that described with reference to FIG. 8(*b*). The sound wave guide paths having a predetermined width around the center lines are formed in the throat portion 110. For easier understanding of problems, the widths of the paths are illustrated as enlarged in FIGS. 9(*a*) to 9(*c*).

The sound wave is transmitted through the respective path extending from the branch point D1 to the outlets t1, t2, t3, t4, and t5. The path lengths of these paths are defined along the center lines indicated by the dashed lines. It may be assumed that a time period required for the sound wave to be transmitted from the branch point D1 to the outlets t1, t2, t3, t4, and t5 is equal to a time period obtained by dividing the path length by a sound speed. In the throat portion 110 of FIG. 9(*a*), the sound wave is transmitted from the branch point D1 to outlets t1, t2, t3, t4, and t5 through the paths in the same time period.

In the throat portion 110 of FIG. 9(*a*), two paths extend from the branch point D1 to the branch points D2, and four paths extend from the branch points D2 to the branch points D3. The paths extending from the branch point D1 to the branch points D2 have a constant width and the paths extending from the branch points D2 to the branch points D3 have a constant width. In addition, the paths extending from the branch point D1 to the branch points D2 are equal in width to the paths extending from the branch points D2 to the branch points D3. So, a sum of the widths of the paths extending from the branch points D2 to the branch points D3 is twice as large as a sum of the widths of the paths extending from the branch point D1 to the branch points D2. In other words, the sum of the widths rapidly increases at the branch points D2. This means that smooth transmission of the sound wave may be impeded at the branch points D2. Such a problem arises at the branch points D3.

In the throat portion 111 of FIG. 9(*b*), the problem has been solved. The shape of the dashed line of FIG. 9(*b*) is identical to the shape of the dashed line in FIG. 9(*a*). In the throat portion 111 of FIG. 9(*b*), each of the branch points D1, D2, and D3 on these dashed lines conforms to an intersection of side walls of the paths extending in two directions from the corresponding branch point. Thereby, the problem that the sum of the widths of the paths rapidly increases at the branch points D2 and D3 has been solved. As can be seen from FIG. 9(*b*), the sum of the widths of the paths gradually increases in a range from the branch point D1 to the branch points D2, and the sum of the widths of the paths gradually increases in a range from the branch points D2 to the branch points D3. So, the sum of the widths of the paths does not rapidly increase at the branch points D2. The same applies to the branch points D3. Therefore, it is expected that in the throat portion 111 of FIG. 9(*b*), the sound wave is transmitted smoothly at the branch points D2 and D3.

As described above, it may be assumed that the time period required for the sound wave to be transmitted from the branch point D1 to the outlets t1, t2, t3, t4, and t5 is equal to a time period obtained by dividing the path length by a sound speed.

The throat portion 111 of FIG. 9(*c*) is identical to the throat portion 111 of FIG. 9(*b*). The two-dotted lines of FIG. 9(*c*) indicate center lines of the paths of the throat portion 111. The two-dotted lines of FIG. 9(*c*) pass through middle points in the width direction of the paths just after the branch points D1, D2, and D3. So, it may be assumed that the length of each of the paths extending from the branch point D1 to the outlets t1, t2, t3, t4, and t5 is defined along the two-dotted line, i.e., the length defined along the line passing through the middle point in the width direction of each path just after the branch points D1, D2, and D3. Assuming that the sound wave is transmitted along the two-dotted lines, the time required for the sound wave to be transmitted from the branch point D1 to the outlets t1, t2, t3, t4, and t5 is estimated. In the throat portion 111 of FIG. 9(*c*), for example, the length of the two-dotted line extending from the branch point D1 to the outlet t3 is shorter than the length of the two-dotted line extending from the branch point D1 to the outlet t1. Thus, in the throat portion 111 of FIG. 9(*c*), the paths have different lengths. As a result, the wavefront of the sound wave emitted from the outlet opening 143 does not conform in shape to the convex circular arc of the outlet opening 143. In order to cause the wavefront of the sound wave emitted from the outlet opening 143 to conform in shape to the convex circular arc of the outlet opening 143, it is necessary to alter the configurations of the sound passage space of FIGS. 9(*b*) and 9(*c*) in some degree.

Figure 10A:
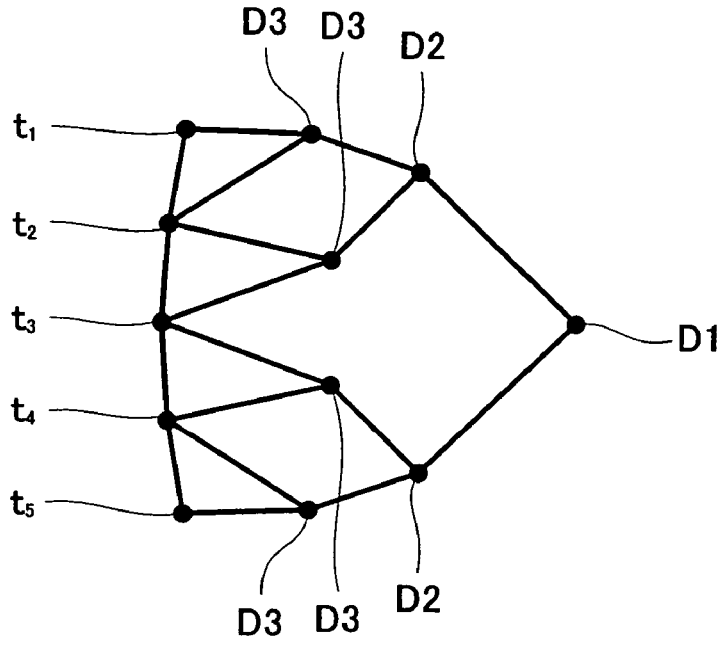
FIGS. 10(*a*) and 10(*b*) are schematic views of sound passage space, illustrating alternations of the sound passage space shown in FIGS. 9(*b*) and 9(*c*)
Figure 10B:
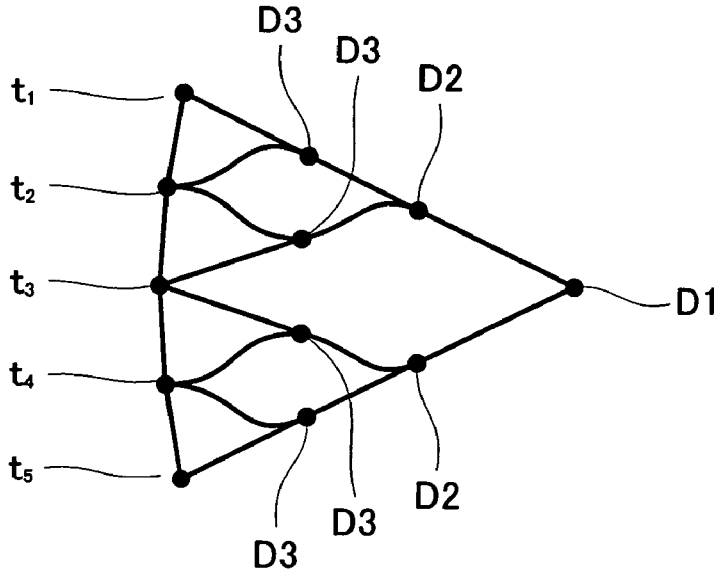

FIGS. 10(*a*) and 10(*b*) are schematic views of sound passage space for explaining alternations. The sound wave guide structures of FIGS. 10(*a*) and 10(*b*) are provided with outlet openings having slit shapes extending to be curved in a convex circular arc shape as shown in FIG. 8(*b*).

The sound wave guide structure of FIG. 10(*a*) includes paths configured to extend in a straight line shape from a branch point to another branch point. The branch point D1 and the outlets t1, t2, t3, t4, and t5 of FIG. 10(*a*) are arranged at the same positions as those of the branch point D1, and the outlets t1, t2, t3, t4, and t5 of FIG. 8(*b*). The branch points D2 and D3 of FIG. 10(*a*) are arranged at positions different from those of the branch points D2 and D3 of FIG. 8(*b*). More specifically, the branch points D2 and D3 of FIG. 10(*a*) are located outward relative to those of the sound wave guide structure of FIG. 8(*b*). By applying the design method of the path described with reference to FIG. 9(*b*) to the shape of the sound wave guide structure of FIG. 10(*a*), the paths extending from the branch points D1 to the outlets t1, t2, t3, t4, and t5 are caused to have an equal path length. In other words, it is possible to design the throat portion so that the wavefront of the sound wave emitted from the outlet opening conforms in shape to the convex circular arc of the outlet opening and the sound wave is transmitted smoothly at the respective branch points.

In the sound wave guide structure of FIG. 10(*b*), all of paths extending from a branch point to the next branch point do not extend in a straight line shape, but some of them extend in a curved line shape. More specifically, the paths extend in a straight line shape from the branch point D1 to the branch points D2. The paths extend in a straight line shape from the higher second branch point D2 to the highest third branch point D3 and from the lower second branch point D2 to the lowest third branch point D3. The paths extend in a curved line shape (S shape) from the higher second branch point D2 to the second highest third branch point D3 and from the lower branch point D2 to the second lowest third branch point D3. The paths extend in a straight line shape from the highest third point D3 to the outlet t1, from the second highest third branch point D3 to the outlet t3, from the second lowest third branch point D3 to the outlet t3, and from the lowest third branch point D3 to the outlet t5. The paths extend in a curved line shape (S shape) from the highest third branch point D3 to the outlet t2, from the second highest third branch point D3 to the outlet t2, from the second lowest third branch point D3 to the outlet t4, and from the lowest third branch point D3 to the outlet t4. The branch points D1, D2, and D3, and the outlets t1, t2, t3, t4, and t5 in FIG. 10(*b*) are arranged at the same positions as those of the branch points D1, D2, and D3, and the outlets t1, t2, t3, t4, and t5 in FIG. 8(*b*). By applying the design method of the path described with reference to FIG. 9(*b*) to the shape of the sound wave guide structure of FIG. 10(*a*), the paths extending from the branch point D1 to the outlets t1, t2, t3, t4, and t5 are caused to have an equal path length. In other words, it is possible to design the throat portion so that the wavefront of the sound wave emitted from the outlet opening conforms in shape to the convex circular arc of the outlet opening and the sound wave is transmitted smoothly at the respective branch points.

As can be seen from comparison between FIG. 10(*a*) and 10(*b*), the sound passage space of FIG. 10(*a*) is configured such that the paths are bent sharply at some points. For example, in the structure of the sound passage space of FIG. 10(*a*), the paths are bent sharply at the branch points D2, whereas in the structure of the sound passage space of FIG. 10(*b*), the paths do not include sharply bent points. For this reason, in the structure of FIG. 10(*b*), unwanted reflection of sound wave is less likely to occur. In other words, energy loss is less in the structure of FIG. 10(*b*).

Figure 11:
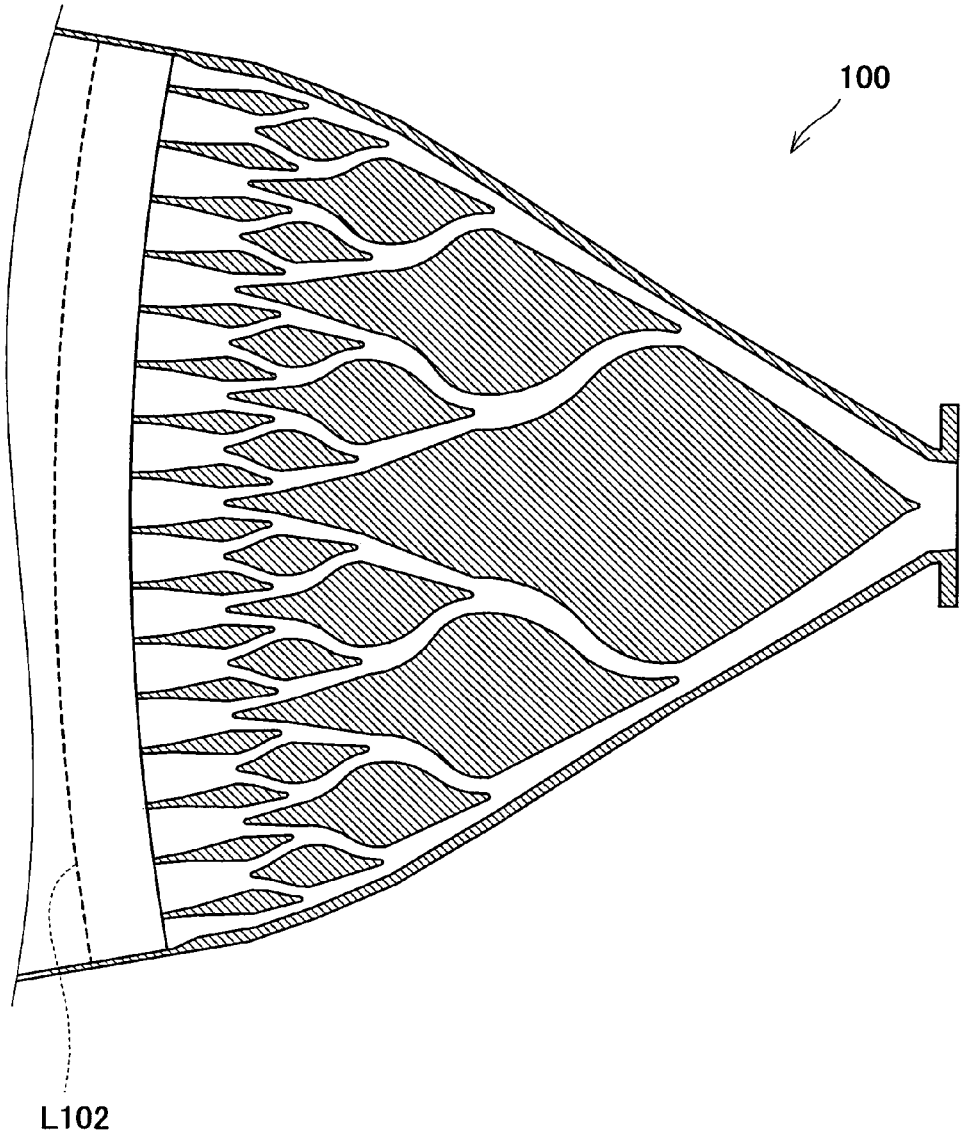
FIG. 11 is a longitudinal sectional view of the horn speaker.
Figure 12:
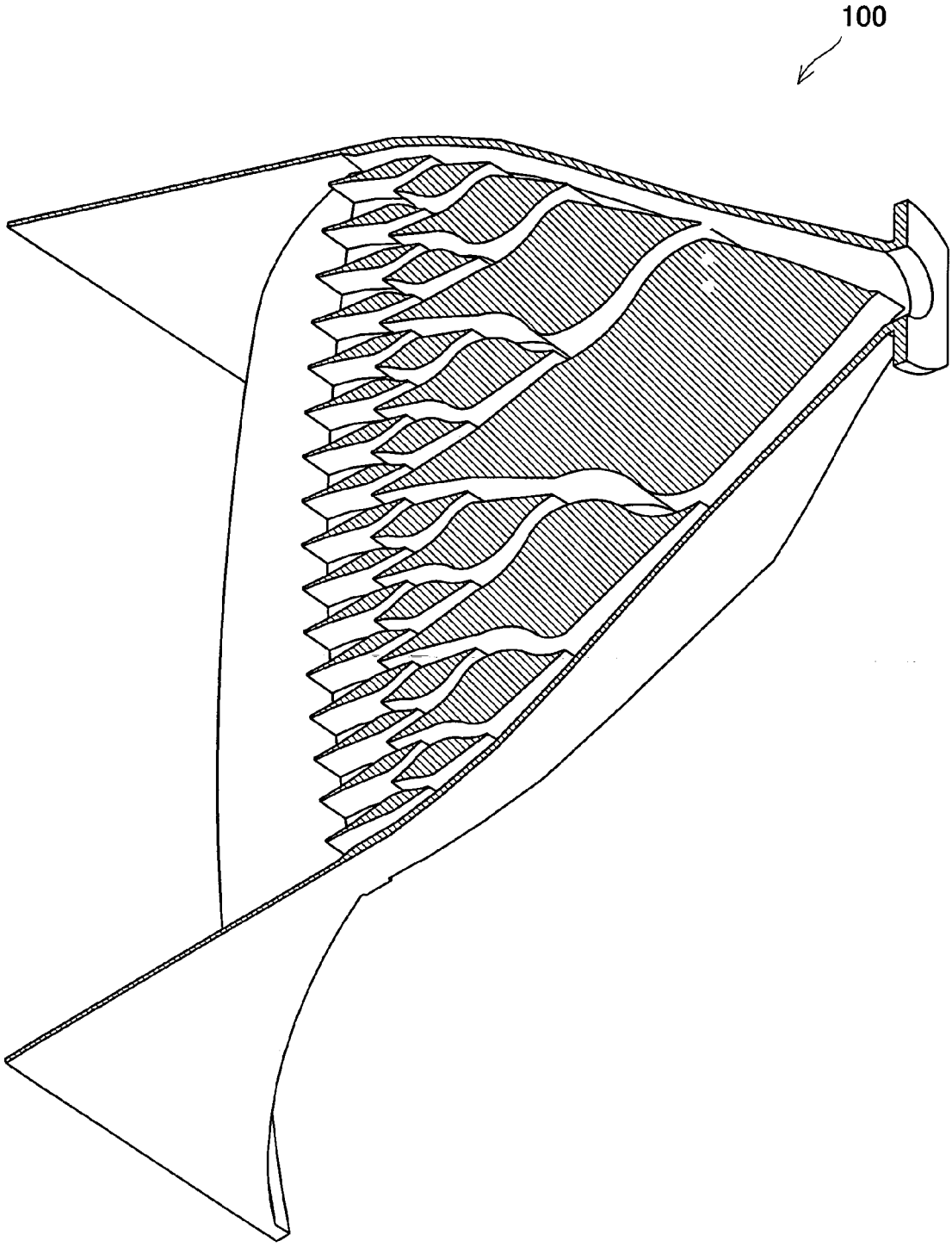
FIG. 12 is a longitudinal sectional view of the horn speaker, as seen from obliquely downward.

FIG. 11 is a longitudinal sectional view of the horn speaker 100. The horn speaker 100 of FIG. 11 is expressed in the same manner as that of the horn speaker 1 of FIG. 3. FIG. 12 is a longitudinal sectional view of the horn speaker 100, as seen from obliquely downward. The horn speaker 100 of FIG. 12 is expressed in the same manner as that of the horn speaker 1 of FIG. 2.

The horn speaker 100 of FIGS. 11 and 12 has a sound passage space structure designed so that a part of the paths extend in a curved line shape (S shape) so as not to include sharply bent points as shown in FIG. 10(*b*) and the paths have a substantially equal path length.

A broken line L102 of FIG. 11 schematically shows the wavefront of the sound wave that has been just emitted from the outlet opening of the slit shape extending to be curved in a convex circular arc shape. The shape of a wavefront L102 is convex circular arc, similar to the shape of the outlet opening.

Figure 13A:
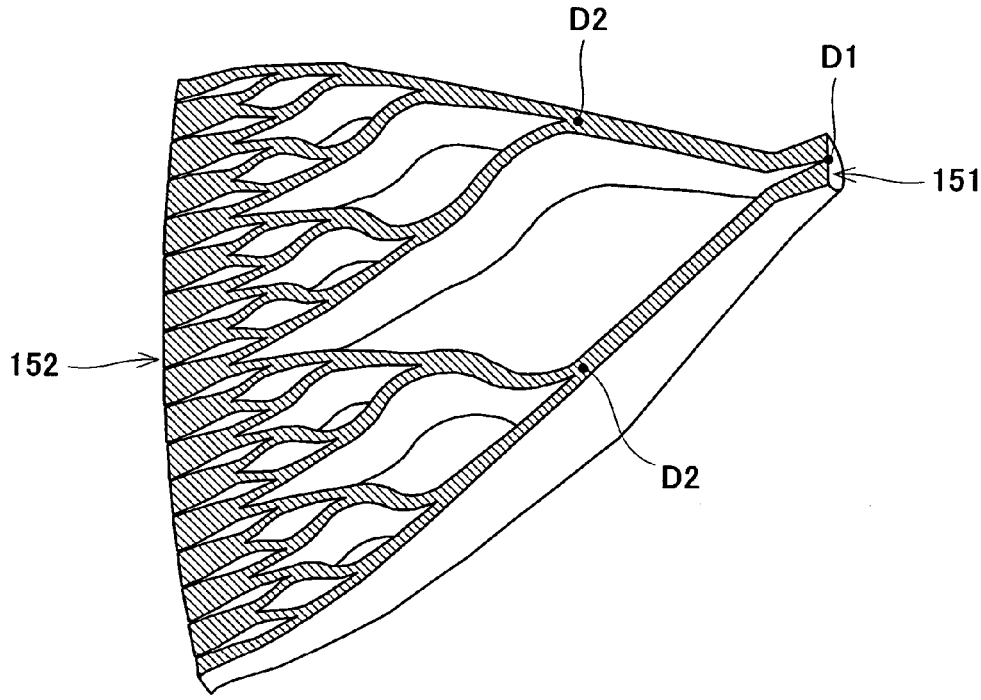
FIGS. 13(*a*) and 13(*b*) are views showing one side of a longitudinal section of the sound passage space of the horn speaker.
Figure 13B:
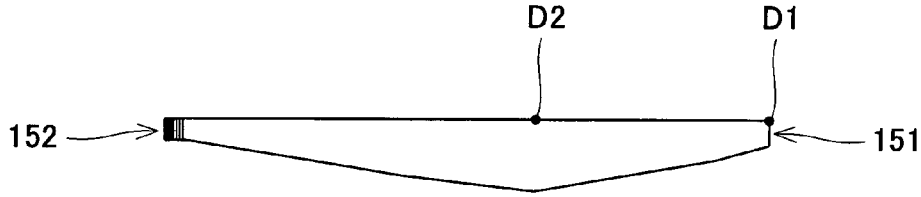

FIG. 13(*a*) and 13(*b*) are views each showing one side of a longitudinal section of the sound passage space of the horn speaker 100 of FIGS. 11 and 12. FIG. 13(*a*) is a view as seen from obliquely downward and FIG. 13(*b*) is a view as seen from downward. The sound passage space is formed as a space in a throat portion or the like of a horn speaker, but is illustrated as a solid model in FIGS. 13(*a*) and 13(*b*).

As can be seen from FIGS. 13(*a*) and 13(*b*), the sound passage space is configured such that the path has a largest height at the second branch points D2. Its height gradually decreases from the branch points D2 to an inlet opening 151. In addition, its height gradually decreases from the branch points D2 to an outlet opening 152.

The sound passage space is thus configured to have the largest height at the branch points D2, in order to decrease the width of the paths at these points (branch points) D2. This is because, if the sound passage space has a extremely wide region, interference at a high frequency increases in the region, causing a large energy loss. This is noticeable when the width of the path becomes large at a path direction change point, such as the branch points.

If the height is substantially constant from the inlet opening to the outlet opening in the paths of the horn speaker 100, then the width of the paths at the branch points D2 becomes too large. For this reason, as shown in FIGS. 13(*a*) and 13(*b*), the path is configured to have the largest height at the branch points D2.

In an intermediate region between the inlet opening 151 (in the vicinity of the branch point D1 in the example of FIG. 13) and the outlet opening 152 of the sound passage space, branch points for causing the direction of the paths are formed. The sound passage space is desirably configured to have the largest height in the intermediate region between the inlet opening 151 and the outlet opening 152 of the sound passage space, although the branch points are merely exemplary.

Figure 14:
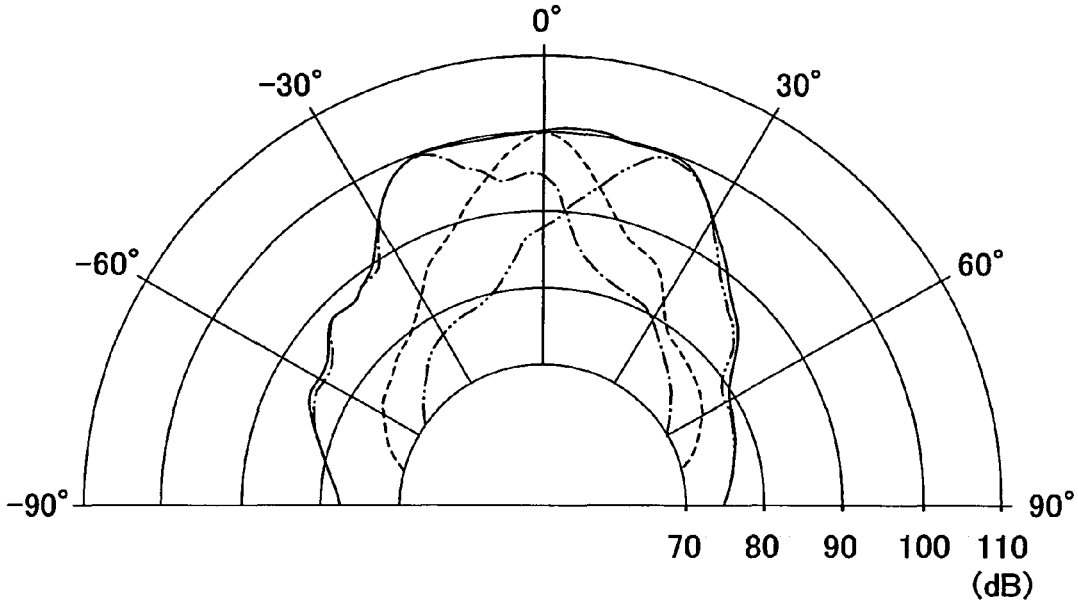
FIG. 14 is a view showing a characteristic obtained by measuring directivities of three adjacent horn speakers.

FIG. 14 is a view showing a characteristic obtained by measuring directivities of three adjacent horn speakers with a directivity angle of 20 degrees according to the present invention. In this view, a radial axis indicates a sound pressure level. In this measurement, the three horn speakers are arranged in different orientations by 20 degrees. Specifically, one of the three horn speakers is placed to face directly forward (0 degree direction) and the other two are placed to face orientations of −20 degrees and 20 degrees. A measurement signal is a noise signal having a 5000 Hz center frequency and a frequency component with a ⅓ octave width. An identical signal is supplied to the three horn speakers.

In FIG. 14, a broken line indicates a characteristic curved line obtained by independently driving the horn speaker placed to face directly forward. A dashed line indicates a characteristic curved line obtained by independently driving the horn speaker placed to face the orientation of −20 degrees and a two-dotted line indicates a characteristic curved line obtained by independently driving the horn speaker placed to face the orientation of 20 degrees. A solid line indicates a characteristic curved line obtained by driving these three horn speakers together.

As can be seem from FIG. 14, the characteristic curved line indicated by the solid line shows a substantially even sound pressure distribution (sound pressure distribution in which a decrease in a sound pressure with respect to a sound pressure in a directly forward direction is within 6 dB) in an angular range of about 60 degrees with respect to the directly forward direction. In the characteristic curved line indicated by the solid line, no valley is recognized in directions (specifically, direction of about −10 degrees and direction of about 10 degrees) that become boundaries of angular ranges covered by the respective horn speakers 100.

This means that the sound wave is emitted in substantially isophase over a substantially entire range of the outlet openings of the respective horn speakers, i.e., the wavefront of the convex circular arc shape that is substantially identical to that of the outlet openings is formed.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention.

INDUSTRIAL APPLICABILITY

A sound wave guide structure for a speaker system and a horn speaker of the present invention are capable of controlling a wavefront of a sound wave emitted therefrom as desired and correctly using a simple structure, and hence is advantageous in technical fields of acoustic equipment.

The invention claimed is:

1. A sound wave guide structure for a speaker system comprising:

a sound passage space connecting an inlet opening to an outlet opening, the sound passage space being configured to branch in plural stages in a range from the inlet opening to the outlet opening to form a plurality of sound wave guide paths extending from the inlet opening to the outlet opening, wherein at least one sound wave guide path is branched into a first branch and a second branch at a first branch point, the first branch extending substantially linearly, the second branch being angled with respect to the first branch, and the second branch extending in a curved shape and having a length substantially the same as a length of the first branch between the first branch point and a second branch point downstream of the first branch point.

2. The sound wave guide structure for a speaker system according to claim 1, wherein center axes of the plurality of sound wave guide paths are included in a flat plane.

3. The sound wave guide structure for a speaker system according to claim 1, wherein center axes of the plurality of sound wave guide paths are included in a curved plane or a bent plane.

4. The sound wave guide structure for a speaker system according to claim 1, wherein the outlet opening has a slit shape, and the sound wave guide path branches at respective branch points in a longitudinal direction of a slit of the outlet opening.

5. The sound wave guide structure for a speaker system according to claim 4, wherein the outlet opening of the slit shape extends in a straight line shape.

6. The sound wave guide structure for a speaker system according to claim 4, wherein the outlet opening of the slit shape extends to be curved in a convex curved line shape.

7. The sound wave guide structure for a speaker system according to claim 4, wherein the outlet opening of the slit shape extends to be curved in a convex circular arc shape.

8. The sound wave guide structure for a speaker system according to claim 4, wherein the outlet opening of the slit shape extends to be curved in a concave curved line shape.

9. The sound wave guide structure for a speaker system according to claim 4, wherein the outlet opening of the slit shape extends to be curved in a concave circular arc shape.

10. The sound wave guide structure for a speaker system according to claim 1, wherein essentially all of the plurality of sound wave guide paths have a substantially equal path length.

11. The sound wave guide structure for a speaker system according to claim 4, wherein the sound wave guide path having an outlet at a position closer to a center of the outlet opening of the slit shape has a shorter path length.

12. The sound wave guide structure for a speaker system according to claim 4, wherein the sound wave guide path having an outlet at a position closer to a center of the outlet opening of the slit shape has a longer path length.

13. The sound wave guide structure for a speaker system according to claim 10, wherein the path length is defined along a line passing through a middle point in a width direction of the path just after a branch point.

14. The sound wave guide structure for a speaker system according to claim 1, wherein at least part of at least one of the plurality of sound wave guide paths extends in a S shape.

15. The sound wave guide structure for a speaker system according to claim 1, wherein at least one of the plurality of sound wave guide paths has a largest height in an intermediate region between the inlet opening and the outlet opening of the sound passage space.

16. The sound wave guide structure for a speaker system according to claim 15, wherein the sound wave guide path has the largest height at a branch point thereof or in the vicinity of the branch point.

17. The sound wave guide structure for a speaker system according to claim 1, wherein sound wave guide paths branch from a branch point, and the sound wave guide paths extending from the branch point merge at a merge point.

18. A horn speaker in which the sound wave guide structure for a speaker system according to claim 1 is applied to a throat portion thereof.

19. The sound wave guide structure for a speaker system according to claim 1, wherein center axes of the plurality of sound wave guide paths are included in a flat plane.

20. The sound wave guide structure for a speaker system according to claim 1, wherein center axes of the plurality of sound wave guide paths are included in a curved plane or a bent plane.

21. A sound wave guide structure for a speaker system comprising:

a sound passage space connecting an inlet opening to an outlet opening;

the sound passage space defining a longitudinal axis;

a plurality of branch points formed within the sound passage space, each of the branch points arranged to branch a portion of the sound passage space from a first branch path to second and third branch paths; and a plurality of stages spaced apart along the longitudinal axis, each of the plurality of branch points disposed at one of the plurality of stages, wherein the second branch path extends substantially linearly, the third branch path being angled with respect to the second branch path, and the third branch path extends in a curved shape and has a length substantially the same as a length of the second branch path between the first branch point and a second branch point downstream of the first branch point.

22. The sound wave guide structure of claim 21, wherein the sound passage space includes a throat portion having abuse end adjacent the inlet opening and a tip end, and wherein a first one of the plurality of stages is disposed adjacent the base end of the throat portion and a second one of the plurality of stages is disposed adjacent a midpoint of the throat portion measured along the longitudinal axis.

23. The sound wave guide structure of claim 22, wherein a third one of the plurality of stages is disposed adjacent a midpoint between the second one of the plurality of stages and the tip end of the throat measured along the longitudinal axis.

24. The sound wave guide structure of claim 21, wherein the outlet opening is slit shaped and wherein the sound passage exits the tip end of the throat portion aligned along the slit shaped outlet opening.

25. The sound wave guide structure of claim 1, wherein the first branch and the second branch are arranged asymmetrically with respect to the one sound wave guide path.

26. A sound wave guide device as part of a speaker system, the sound wave guide device comprising:

an inlet opening coupled to a speaker device;

a plurality of outlet openings aligned in a first direction; and a plurality of sound wave paths extending from the inlet opening to the outlet openings and being divided by a plurality of branch points, the plurality of branch points being present between the inlet opening and the outlet openings and dividing the plurality of sound wave paths into a plurality of branches, wherein a first branch point divides a first sound wave path into first and second branches, the first branch extending substantially linearly from the first sound wave path, the second branch being angled with respect to the first sound wave path, and the second branch is curved so that a length of the second branch is substantially the same as a length of the first branch between the first branch point and a second branch point.

* * * * *